United States Patent [19]

Spaude

[11] Patent Number: 4,547,734

[45] Date of Patent: Oct. 15, 1985

[54] EQUIPMENT FOR RECOGNIZING MISFIRING

[75] Inventor: Heinz-Werner Spaude, Aichtal, Fed. Rep. of Germany

[73] Assignee: Daimler-Benz Aktiengesellschaft, Fed. Rep. of Germany

[21] Appl. No.: 473,591

[22] Filed: Mar. 9, 1983

[30] Foreign Application Priority Data

Mar. 10, 1982 [DE] Fed. Rep. of Germany ..... 3208587

[51] Int. Cl.[4] ..... F02P 17/00

[52] U.S. Cl. ..... 324/395; 324/399; 324/378; 315/209 T; 315/209 M

[58] Field of Search ..... 315/209 T, 209 M; 324/378, 379, 380, 395, 399

[56] References Cited

U.S. PATENT DOCUMENTS

| | | | |
|---|---|---|---|
| 3,452,270 | 6/1969 | Cook | 324/395 |
| 3,942,102 | 3/1976 | Kuhn et al. | 324/399 |
| 4,006,403 | 2/1977 | Olsen et al. | 324/399 X |
| 4,331,921 | 5/1982 | Walker | 324/380 |
| 4,333,054 | 6/1982 | Walker | 324/380 |
| 4,349,782 | 9/1982 | Doss | 324/395 X |

FOREIGN PATENT DOCUMENTS

| | | | |
|---|---|---|---|
| 0020068 | 12/1980 | European Pat. Off. | 324/380 |
| 2912142 | 10/1980 | Fed. Rep. of Germany | 324/395 |

*Primary Examiner*—David K. Moore
*Assistant Examiner*—Vincent DeLuca
*Attorney, Agent, or Firm*—Craig and Burns

[57] ABSTRACT

An equipment for recognizing misfiring, which is particularly suitable for permanent installation in a motor vehicle. By means of high-pass filters coupled to the plug leads between the spark distributor and the spark plugs, the change to the voltage at the spark plugs associated with the initiation of the ignition spark is sensed. The high-pass filters are so arranged that they only send on a needle-shaped output pulse signal to an analysis circuit if it appears with the change in voltage associated with the spark front. The analysis circuit generates appropriate output signals with reference pulses generated in time with the ignition pulses. The high-pass filters are preferably arranged as simple RC filters whose capacities are coupled to the plug leads by means of peripheral electrodes, which at least partially surround the insulation coatings of the plug leads.

37 Claims, 11 Drawing Figures

EQUIPMENT FOR RECOGNIZING MISFIRING

The present invention relates to equipment for recognizing misfiring in externally controlled ignition internal combustion engines, in which the ignition voltage is conducted to each of the ignition circuits of the ignition installation associated with a spark plug in the prescribed order by means of a spark distributor.

Such equipment is known from the German Auslegeschrift No. 2,326,839 in association with conventional battery ignition installation, in which the ignition voltage is produced in the secondary circuit of an ignition coil.

Misfirings occur whenever the voltage supplied by the ignition voltage source, for example, an ignition coil or an ignition transformer, is insufficient to ensure that the ignition spark occurs across the spark gap of a spark plug.

Possible reasons for the occurrence of misfirings are, for example:

- too large a distance between the electrodes of the spark plug, caused by burning or corrosion of the plug
- plug electrodes dirtied with lead residues or oil
- other electrical by-passes in the ignition circuit
- too weak a mixture setting or
- retarded time of ignition.

In the case of only sporadic occurrence, misfirings cause uneven running of the internal combustion engine, for example, the driving engine of a motor vehicle, and a drastic drop in power of the engine if the occurrence continues. In any event, they are an indication that the voltage being so selected that, with correct functioning of the ignition installation, the output voltage of the integrating element is less than the arcing voltage as long as the ignition spark is in existence. Thus, with correct functioning of the ignition system, the output signal of the first differential amplifier is a high-level output signal and the output signal of the second differential amplifier is a low-level output signal because the integral of the arcing voltage does not exceed the threshold value characteristic of correct functioning of the ignition equipment. If, for example, there are electric by-passes in the ignition circuit, as a result of which the ignition voltage at the currently operative plug spark gap is not attained and the secondary voltage of the ignition coil decays relatively slowly, then the output signal of the first differential amplifier is a low-level signal and the output signal of the second differential amplifier is a high-level signal. If, during an ignition process with a defective plug connection, several arcs occur in the latter and hence the ignition spark again does not occur at the plug, the output signal of the second differential amplifier in this ignition process is also a high-level output signal and at the same time, the output signal of the first differential amplifier can also be a high-level output signal. The output signal combinations of the two differential amplifiers characteristic of correct functioning and of erroneous functioning of the ignition equipment resulting from various causes are processed in a logic analysis circuit to corresponding indicator signals.

The known equipment, because of the constructional and functional properties described above, is subject to at least the following disadvantages:

If the plug spark gap is bridged by by-passes of relatively low ohmic resistance, so that following the arc across the distributor spark gap its discharge current can discharge by way of the spark plug by-passes at low arcing voltage, the variation in voltage in the secondary circuit of the ignition coil with a very rapid change in voltage at the time of the arc across the distributor spark gap and a low value of the arcing voltage across it, then corresponds substantially with that of a normal ignition process and, although the ignition spark does not occur at the plug, an output signal combination is produced at the outputs of the two differential amplifiers which corresponds to that of a normal ignition process; misfirings occurring in this manner can therefore, on the one hand, not be recognized reliably by the known equipment. On the other hand, in cases in which the ignition voltage requirement of the plug spark gap is very low, it is possible with the known equipment that the first amplitude discriminator will not respond because the voltage change associated with the spark front is too small and thus a signal combination is produced at the outputs of the two differential amplifiers which is characteristic of erroneous functioning of the ignition equipment. The known equipment can therefore not be considered for use as installed vehicle equipment to provide the driver with the most comprehensive possible information on when maintenance work is necessary but which, on the other hand, should also help avoid unnecessary maintenance work, even allowing for its suitability for diagnosing a limited number of causes of failures in the ignition system of a vehicle engine. In addition, the known equipment would be too complex and expensive for this purpose because of its complicated construction. This would apply even if—in a conceivable simplification of its construction in the area of its analysis circuit—only one logic connection of the output signals of the two amplitude discriminators providing the recognition of misfiring would be realized.

The object of the present invention is therefore to provide an equipment of the type mentioned hereinabove which provides a more reliable and more comprehensive recognition of misfirings in an internal combustion engine and which can be manufactured sufficiently simply and cost effectively so that it can possibly be employed as installed or onboard equipment of a motor vehicle.

The underlying problems are solved in accordance with the present invention in that a high-pass filter is provided for each ignition circuit, by means of which a voltage signal can be decoupled from the ignition circuit, which is associated exclusively with the voltage changes occurring at the start of the ignition spark over the spark gap of the plug, in that these high-pass filters are coupled to the respective ignition circuits between the fixed electrodes of the ignition distributor and the spark plugs, in that a reference circuit is also provided which generates electrical output signals characteristic of the required or intended firing points of the ignition circuits of the internal combustion engine, and in that an evaluation and indicating circuit, to which the output signals of the high-pass filters are supplied in the form of an OR-connection, produces the output signals characteristic of correct or erroneous functioning of the ignition installation from a logic processing of the filter output signals and of the reference circuit output signals. According to this solution, a high-pass filter used as a differentiating element is associated with each of the ignition circuits of the internal combustion engine, each of which contains a spark plug, the lower frequency limit of this high-pass filter being chosen sufficiently high so that it responds only to very rapidly occurring changes in voltage, i.e. the voltage changes associated with the so-called spark front which is initiated at the time of ignition, and so that it transmits correspondingly high frequency voltage signals; these high-pass filters are coupled—preferably capacitatively—to each of the ignition circuits between the ignition distributor and the plug. They are so arranged that they transmit to the analysis circuit only the differentiation signals associated with the change in voltage associated with the formation of the spark front, whereas differentiation signals which are associated with changes in voltage in the opposed direction of alteration are suppressed by short-circuit elements, for example suitably poled diodes. This totally avoids that voltage changes occurring by way of the upstream spark gap of the ignition distributor are further transmitted by way of the high-pass filters to the analysis circuit and thus imitate a correct functioning of the ignition installation whereas, objectively, an error situation is present. The equipment according to the present invention provides to this extent a more reliable recognition of misfirings and is thus also better suited for use for permanent installation in a vehicle; in addition, the equipment according to the present invention possibly using electronic rpm generators available in the vehicle as part of its reference circuit, can be realized cost effectively and is therefore to this extent more suitable for use as a permanent installation in a motor vehicle.

If the distance apart of the lower limit frequency of the high-pass filters is at least 100 times larger than the natural frequencies of the respective ignition circuit of the internal combustion engine, then simple RC-filters can be employed as high-pass filters.

If the high-pass filters respectively differentiating elements are constructed in accordance with the teachings of this invention, their coupling capacities can with advantage be effected by the described arrangement of surface electrodes by means of which the OR connection of the filter output signals is also achieved in a simple manner.

In conjunction with this, an arrangement of the common shunt resistance of the high-pass filters in direct proximity of the coupling capacitors is favorable to the suppression of interfering electric eddy fields.

If the high-pass filters are coupled inbetween the suppressor resistance provided for each plug, which is located in the plug connection, and the plug spark gap, the coupling filters can be employed with advantage, whose lower limit frequency is substantially higher, for example, is approximately 100 MHz or still higher. With such a filter construction, the filters can still only transmit voltage change signals which are initiated by correspondingly rapidly occurring voltage changes. A sufficiently rapid change in plug voltage is given in the first phase of the formation of the spark front as long as this is fed from the discharge of the plug capacity, whose discharge time constant is smaller by two to three orders of value than the discharge time constants of the individual ignition plugs determined mainly by the substantially greater capacities of the spark leads and the suppressor resistances; the best possible guarantee is therefore given by coupling and designing the high-pass filters in such way that when a filter output signal appears, it has actually been initiated by an ignition spark arcing across the plug spark gap. In this connection, it can also be useful if, in addition to the high-pass filters with high limit frequency coupled to the plugs, a filter set with a lower limit frequency is also provided, which is coupled between the ignition distributor and the suppressor resistance. If, in this case, an ignition spark signal is transmitted over the "slow" filters but not over the "rapid" filters coupled to the plugs, then it is certain that the transmitted signal can only derive from an arc with its origin in the plug lead and to this extent, the localization of an error occurring in the ignition equipment is also made easier.

A corresponding result is achieved if, in addition to or alternatively to the "slow" and/or "rapid" high-pass filters, current sensor equipment is provided, which generates only an output signal to be processed in the analysis circuit if the high ignition spark current associated with the spark front flows across the plug spark gap.

According to another feature of this invention, the reference circuit and analysis circuits together with indicator equipment can be realized in a simple manner using conventional electronic circuit technology, yet these circuits and equipment assure a reliable processing of the high-pass filter and current-sensor output signals into misfire recognition signals and indications of the ignition circuit affected by the misfirings.

A particularly simple construction of the misfire recognition equipment according to the present invention can be achieved in that a storage element is provided which can be set by signals characteristic of the required or intended ignition points and which can be reset by means of the differentiation output pulses of the high-pass filter. For correct functioning of the ignition equipment, this storage element is then only set for a short period and is immediately reset as soon as the ignition spark occurs. If, however, misfiring occurs, the storage element remains set for a longer period, i.e. until an ignition spark again occurs and a signal suitable for a misfiring indication can be produced in a simple manner by time monitoring of the storage element, which can be effected by means of an integrating element connected in the output of the storage element.

In a preferred embodiment of the misfire recognition equipment in accordance with the present invention, the observation period, within which differentiation output pulses produced for correctly occurring ignition sparks are transmitted to the high-pass filter circuit for processing, is limited to a time window corresponding approximately to the period of time which would pass before the maximum ignition voltage available is obtained when no voltage is applied to the ignition coil. By means of a subdivision of this observation time window, it is possible, for example, as part of the misfire recognition equipment, permanently installed in the vehicle according to this invention, to obtain an indication signal which indicates to the driver that only a limited ignition voltage reserve is still available.

According to still another feature of this invention, the equipment includes such connections as to generate diagnosis signals from the logic processing of signals provided by the processing and connecting circuits of the misfire recognition equipment, the diagnosis signals indicating whether misfiring occurs because of two great a distance between the plug electrodes or because of the ignition voltage available being too low; they thus provide a reliable diagnosis of the statistically most important causes of failure in an ignition system.

If, within the misfire recognition equipment in accordance with the present invention, provision is made for a setting element, by means of which a defined ignition voltage availability can be set, then the ignition voltage reserve of the ignition equipment can be checked by lowering the ignition voltage available.

Particularly suitable for use as installed equipment are those embodiments of the misfire recognition equipment according to the present invention, which provide a warning signal whenever misfiring occurs and/or the ignition voltage reserve drops below a critical minimum value.

Particularly suitable as part of a diagnosis station for maintenance operations are those embodiments of the misfire recognition equipment of the present invention, which also permit diagnosis of the causes of the misfiring.

Finally, the present invention also provides a capacitative coupling grip suitable for such a diagnosis station, by means of which the ignition system of a vehicle, which is not itself equipped with onboard misfire recognition equipment, can be simply connected using a defined value of the coupling capacities to the high-pass filter circuits of the stationary equipment.

These and other objects, features and advantages of the present invention will become more apparent from the following description when taken in conjunction with the accompanying drawing which shows, for purposes of illustration only, several embodiments in accordance with the present invention, and wherein FIG. 1 is a block diagram of the basic layout of an equipment according to the present invention for recognizing misfiring which is in part greatly simplified;

Figure 1:
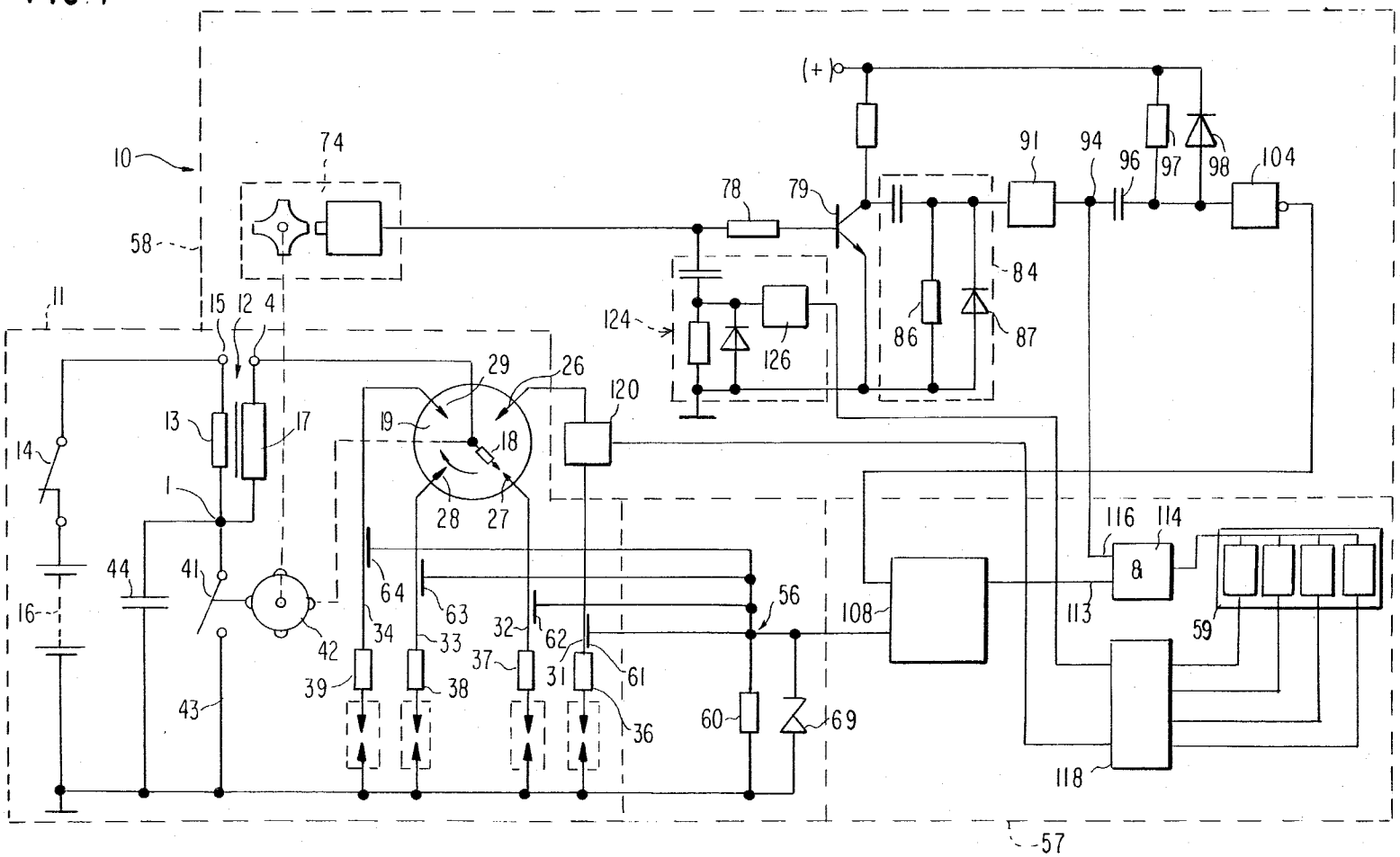

Referring now to the drawing, wherein like reference numerals are used throughout the various views to designate like parts, and more particularly to FIG. 1, this figure illustrates the equipment according to the present invention and generally designated by reference numeral 10 for recognizing misfirings in an external ignition internal combustion engine which, for purposes of explanation, assumes a 4-cylinder driving engine of a motor vehicle and which is represented by the ignition installation 11 shown in the left-hand part of FIG. 1. This ignition installation 11 is, for purposes of simplicity and without limitation to generality, represented with respect to its construction and function as a known, conventional coil ignition system, which has an ignition coil 12 used as the ignition energy store and the ignition high-voltage source, whose primary winding 13 is connected by way of its plus terminal 15 to the vehicle battery 16 when the ignition is switched on, i.e. when the ignition switch 14 is closed, and whose secondary winding 17 is conductively connected by means of its high-tension terminal 4 with the distributor finger 18 of the ignition or spark distributor 19, by way of which the output high tension of the ignition coil 17 is fed in the prescribed ignition order to the ignition circuits associated with the individual spark plugs 21 to 24, which are represented in each case by a spark gap in FIG. 1. The suppressor resistances, which are connected in series with the plugs 21 to 24 and which are located in the plug leads 31 to 34 leading from the fixed electrodes 26 to 29 of the spark distributor to the plugs 21 to 24 and are installed in the plug connections, not shown, are indicated by 36 to 39. The ignition condenser 44 is connected in parallel with the contact-breaker contact 41 of the contact breaker 42, which interrupts and reconnects the current path 43 leading from the common terminal 1 of the primary winding 13 and the secondary winding 17 of the ignition coil 12 to the circuit ground in a periodic series correlated with the activation of the individual ignition circuits.

Figure 3:
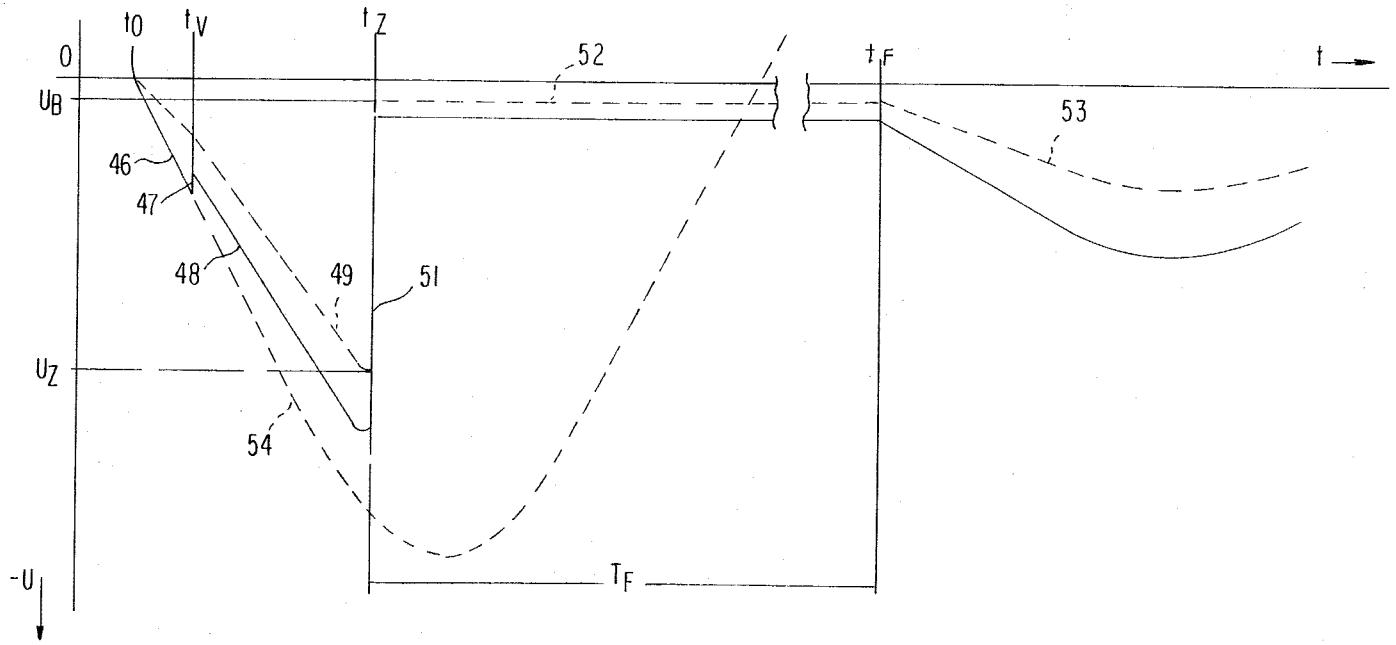
FIG. 3 shows a characteristic variation with time of the voltage in the secondary circuit of an ignition coil arranged as an ignition voltage source for correct operation of an ignition process.

The variation with time of the secondary voltage in the ignition coil 12 resulting from correct ignition operation of the ignition equipment 11 is shown in full lines in FIG. 3, to which attention is drawn initially for explanation of the function of the ignition installation 11 and for concepts used many times in what follows, it being assumed that in order to produce the ignition spark, the negative output high voltage of the ignition coil 12 is applied to the central electrode of the spark plug 21 to 24 currently activated, its opposite electrode being grounded.

At the point in time $t_0$, the cam-controlled breaker contact 41 of the contact breaker 42 is opened and the current path 43, through which the primary current of the ignition coil 12 previously flowed, is interrupted. By this means, a negative high voltage increasing rapidly in magnitude is induced in the secondary winding 17 of the ignition coil 12. Apart from a short initial phase not shown in FIG. 3, in which the capacities affecting the ignition coil are charged, the steepness of the change in voltage initiated practically at the point in time $t_0$ is approximately 0.5 kV/ms. After this initial phase of the secondary age present directly at the ignition coil, which, according to the sign, is decreasing and is shown in the first section 46 of the secondary voltage curve in FIG. 3, there follows, with respect to sign, a positive increase in voltage 47 at the point in time $t_v$, which results from a brief collapse of the voltage in the secondary circuit of the ignition coil whenever, in the ignition distributor, the upstream spark gap formed by the rotating distributor finger contact and the fixed electrode 26, 27, 28 or 29 associated with the currently activated ignition circuit breaks down and thus becomes conductive. From this point on, the—negative—secondary voltage of the ignition coil 12 increases rapidly again, now somewhat less steeply, as shown by the second decreasing part 48 of the secondary voltage curve; from the time $t_v$ onwards, the voltage effective at the currently operating spark plug follows the secondary voltage of the ignition coil 12 approximately with the dashed curve 49 until, at a point in time $t_z$, the ignition voltage $U_z$ of, for example 15 kV is attained at the plug and the ignition spark is initiated; this starts with a short-duration, heavy-current spark front, with which is associated a second, very rapidly occurring increase in voltage 51 of the plug voltage and the ignition coil output voltage, during which the voltage at the sparking plug collapses with a steepness of 1 kV/ms to the relatively small amount of the arcing voltage $U_B$ of, for example, 500 V, at which the spark tail 52 following the spark front 51 continues to arc across until, finally, after a typical spark duration $T_F$ of, for example, 1.5 ms, the energy stored in the ignition coil 12 during the previous closed phase of the contact breaker is used up to the extent that, at time $t_F$, the ignition spark separates and the residual energy still present decays in the final phase 53 in damped current and voltage oscillations. The output voltage available at the ignition coil 12 during the duration of the spark $T_F$ exceeds the arcing voltage $U_B$ of the plug spark gap by the arcing voltage of the upstream spark gap.

If the ignition spark does not occur at the plug, for example because of too high a requirement for ignition voltage as a possible cause for misfiring, a damped sine vibration, subjected to the natural frequency of the ignition circuit appears as the voltage at the plug and as the secondary voltage of the ignition coil; this corresponds to the unloaded voltage of the ignition coil 12, whose first half-wave 54 is also shown in dashed lines in FIG. 3.

So that misfirings resulting from an excessive ignition voltage requirement and/or from the other causes mentioned at the beginning can be reliably recognized, the equipment 10 according to the present invention and according to FIG. 1 is constructed in a particular embodiment as follows:

The main functional element of the equipment 10 is a high-pass filter circuit, generally designated by reference numeral 56, whose lower limit frequency is approximately one MHz and thus approximately 100 times greater than the electrical natural frequency of oscillation of the ignition circuit of the ignition installation 11 located in the secondary circuit of the ignition coil 12. For the particular illustrative embodiment shown, the high-pass filter circuit 56 is capacitatively coupled in each case, to the individual ignition circuits of the internal combustion engine between the fixed electrodes 26 to 29 and the suppressor resistances 36 to 39. It is so designated that it responds only to the voltage rise 51 of the ignition voltage pulses based on an ignition spark coming into existence and associated with the formation of the spark front and transmits only signals derived from these ignition voltage pulses to an analysis and indication circuit indicated generally designated by reference numeral 57; this analysis and indication circuit 57 produces signals suitable for the recognition of misfirings to control an indicator 59 from an appropriate processing of the filter output signals together with further analysis pulses supplied by a reference circuit, generally designated by reference numeral 58.

In the particular illustrative embodiment of FIG. 1, the individual high-pass filters of the circuit 56 are constructed as simple RC-differentiating elements with a common shunt resistance 60 of approximately 100 ohm.

Figure 4:
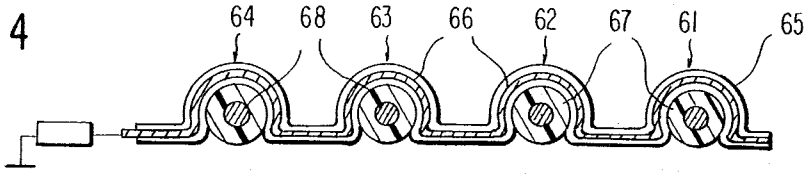
FIG. 4 is a somewhat schematic cross sectional view of a special arrangement of the differentiating elements provided as part of the equipment in accordance with FIG. 1.

Used as the coupling capacities 61 to 64 of these RC-differentiating elements 60, 61 to 60, 64, as shown in differing variants in FIG. 4, are the capacities available between the surface electrodes 66, which are applied to the insulating coating 67 of the plug leads 31 to 34 and the sections of the plug lead cores 68 surrounded completely or only over a sector by these surface electrodes 66; these capacities are of the order of value between 5 and 10 pF if the length of the enclosed plug lead sections is approximately 1 cm. In the particular arrangement shown in FIG. 4, the surface electrodes 66 are made integrally as a bent part from a flat strip-shaped conductor, which is embedded in its turn in an insulating plastic coating 65. This external electrode body can also be used for mechanically fixing the plug leads 31 to 34.

A Zener diode 69, poled to permit passage with respect to the negative voltage pulses, is connected in parallel to the common shunt resistance 60 of the differentiating or high-pass filter elements 60, 61 to 60, 64; this diode 69 represents a short circuit for such negative voltage pulses and thus prevents their further transmission to the analysis circuit 57 and simultaneously limits the peak level of the voltage pulses transmitted to the analysis circuit 57 to a value of, for example, 12 V suitable for further processing.

Figure 2:
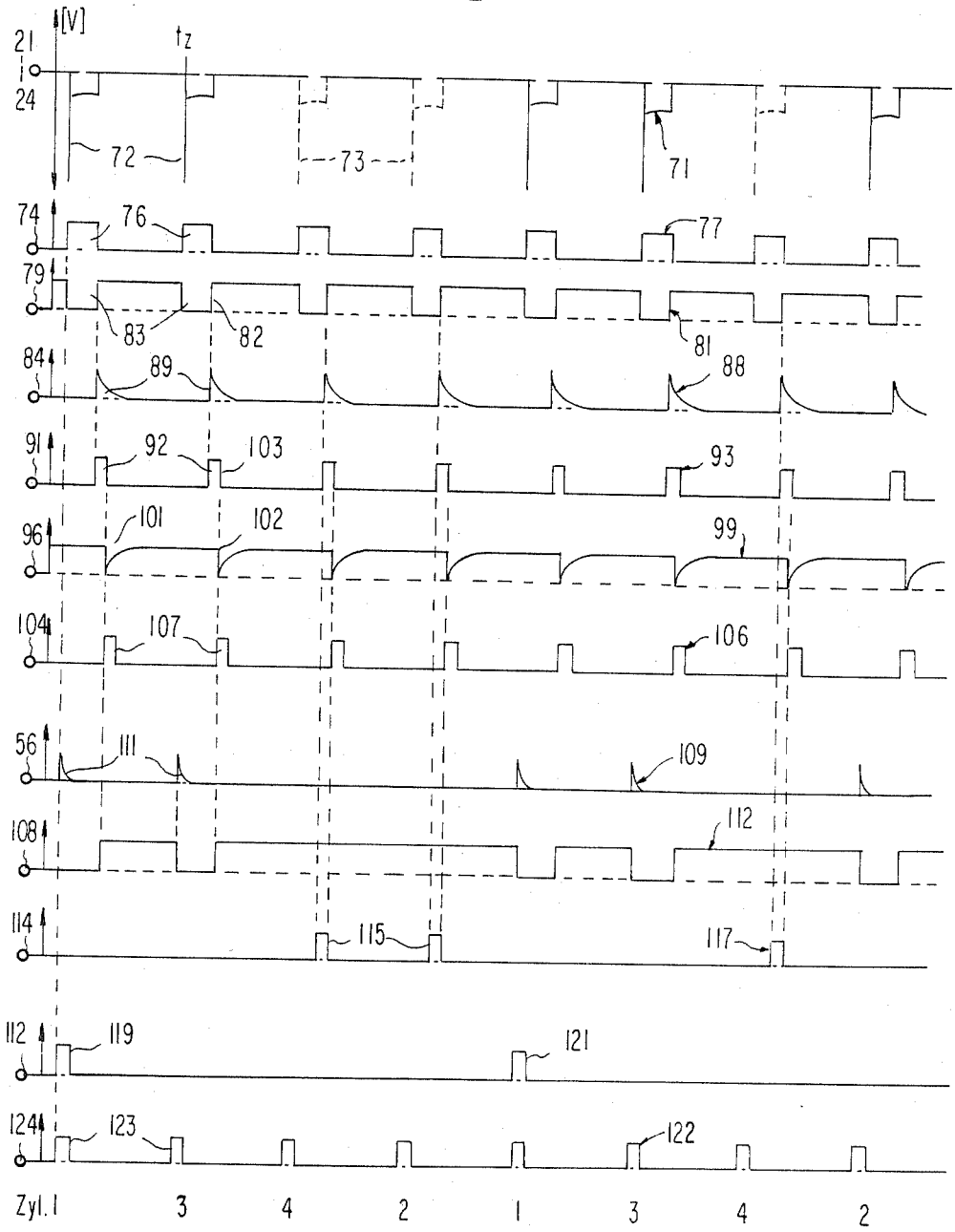
FIG. 2 is a pulse diagram to explain the function of the equipment in accordance with FIG. 1.

In order to explain the construction and function of the reference circuit 58 and the analysis circuit 57, reference is also made to FIG. 2 in what follows. FIG. 2 illustrates a variation with time of the voltage signals generated in the individual functional elements for a series of correctly operating ignition processes interspersed with misfirings, which, in the uppermost pulse series 71 of FIG. 2 is represented by the full lines and dashed lines of the ignition pulses 72 and 73 respectively.

A reference pulse generator 74 synchronized with the contact breaker 42 is provided as part of the reference circuit 58; this pulse generator 74 generates high level rectangular pulses 76 (FIG. 2) occurring at the ignition point in time $t_Z$ or at the required or intended time of ignition, the order in time of these pulses 76 being given by the second pulse series 77 of FIG. 2. A typical duration of these pulses 76, which drop off again approximately with the disappearance of the ignition spark, is 2 ms. The output pulses are supplied by way of a resistance 78 to the base of an NPN transistor 79 operated as inverter in the emitter circuit, the collector output signal of this transistor 79 being illustrated by the third pulse series 81 of FIG. 2. The differentiated pulses 89 occurring together with the rear flanks 82 of the collector output pulses are produced by differentiation of the rising rear flanks 82 of the collector output pulses 83 by means of an RC-differentiating element 84, across whose shunt resistance 86 is connected in parallel a diode 87, poled to permit passage with reference to negative voltage peaks, these differentiated pulses 89 being shown in the fourth pulse series 88 of FIG. 2. These differentiated pulses 89 are supplied to a pulse former 91, which can be constructed as a simple buffer; this pulse former 91 generates high level rectangular pulses 92 occurring together with the rising flanks of the differentiated pulses 89 and having a typical pulse duration of approximately 1 ms; the order in time of these pulses is shown by the fifth pulse series 93 of FIG. 2. These rectangular pulses 92 are used as the analysis pulses for the recognition of misfiring in a manner to be explained more fully hereinafter.

The coupling condenser 96 of an RC-differentiating element, whose shunt resistance 97 is connected with the plus terminal of the supply voltage source, is connected to the output 94 of the pulse former 91. A diode 98, poled in the blocking direction with respect to this supply voltage, is connected in parallel with this shunt resistance 97. A further pulse former 104, which operates as an inverter, is operated by the differentiated output pulse 101, shown by the sixth pulse series 99 of FIG. 2, whose steeply falling front flanks 102 coincide with the falling rear flanks 103 of the analysis pulses 92; this pulse former 104 generates the rectangular pulses 107 shown by the seventh pulse series 106 of FIG. 2, whose typical duration corresponds to that of the output pulses 92 of the first pulse former 91.

Within the analysis circuit 57, there is a trigger circuit 108, constructed, for example, as an RC-flip flop, which can be reset to high output signal level by the high-level output pulses 107 of the pulse former 104 used as the setting pulse generator and to the low-output signal level by the rapidly falling differentiated output signals 111 of the high-pass filter circuit 56 shown in their time order by the eighth pulse series 109. The voltage output signal of the trigger circuit 108 associated with the series of correct ignition operations and repeated and individually occurring misfirings 73 illustrated by the first series of pulses 71 is shown in the ninth pulse series 112 of FIG. 2. The voltage output signal 112 of the trigger circuit 108 is supplied to the input 113 of a two-input AND element 114, which receives the output pulses 92 of the first pulse former 91, thus used as analysis pulse generator, at the other input 116 thereof.

The output signal of the AND element 114 is a low-level signal as long as the differentiated pulse 101 characteristic of the occurrence of an ignition spark is produced in response to a setting pulse 107 in the subsequent ignition process and resets the trigger circuit 108. If, however, this is not the case because of a misfiring, the next analysis pulse 103 causes a misfire recognition pulse 115 at the output of the AND element 114, whose characteristic order in time for the chosen illustrative example is shown by the tenth pulse series 117 of FIG. 2.

A ring counter 118 is provided to identify the ignition circuit currently affected by the occurrence of misfiring; this indicates the currently activated or monitored ignition circuit by its various counter-reading output signals. This ring counter 118 receives as synchronizing pulses 119 the output pulses of a suitable generator 122, shown in their order in time by the eleventh pulse series 121 of FIG. 2; by means of this generator 122, output signals characteristic of the activation of a particular ignition circuit of the internal combustion engine are available, for example, capacitatively or inductively at the plug lead 31 of the ignition circuit which is associated with the first cylinder of the internal combustion engine.

Short-duration output pulses 123 of a beat-pulse or clock pulse generator generally designated by reference numeral 124 and shown by the twelfth pulse series 122 of FIG. 2 are supplied as the beat input signals to the ring counter 118; these output pulses 123 are in turn generated from a differentiation of the rising flanks of the output pulses 76 of the reference pulse generator 74 and appropriate pulse shaping by means of a buffer 126.

As part of the indicator 59, each ignition circuit is provided with its own indicator field with LED indicator diodes, which are each controlled in parallel with the output signals of the AND element 114 and with the counter-reading output signals fo the ring counter 118.

It is obvious that in cases in which an electronically controlled ignition system is provided instead of a conventional mechanical ignition system 11, the induction generator or Hall generator provided as part of this system as the ignition pulse generator thereof can be used instead of the generator 74 of FIG. 1 as the reference pulse generator.

An advantageous modification of the equipment 10 according to the present invention can also consist in providing a set of high-pass filters coupled to the individual ignition circuits between the suppressor resistances 36 to 39 and plugs 21 to 24 and having a lower limit frequency of approximately 100 MHz and thus only responding to very rapidly occurring changes in voltage. Such a short-period change in voltage is the discharge of the plug capacity, considered by itself, occurring during the initiation of the ignition spark, the steepness of this change being even one to three orders of value greater than the steepness of the change in voltage associated with the formation of the spark front 51. With such a construction of the equipment 10, the external electrodes functionally analogous to the surface electrodes 66 of the coupling capacities 61 to 64 in accordance with FIG. 1 are preferably applied direct to the insulation bodies of the spark plugs and each connected to the circuit ground by way of a shunt resistance. High-pass filters formed in this manner transmit an output signal to the analysis circuit 57 only if an ignition spark actually comes into existence at the plugs 21 to 24.

High-pass filters with this property can also be constructed as filters coupled inductively to the plugs; these filters generate an output signal characteristic of the high current associated with the spark front 51 of the ignition spark.

Figure 5:
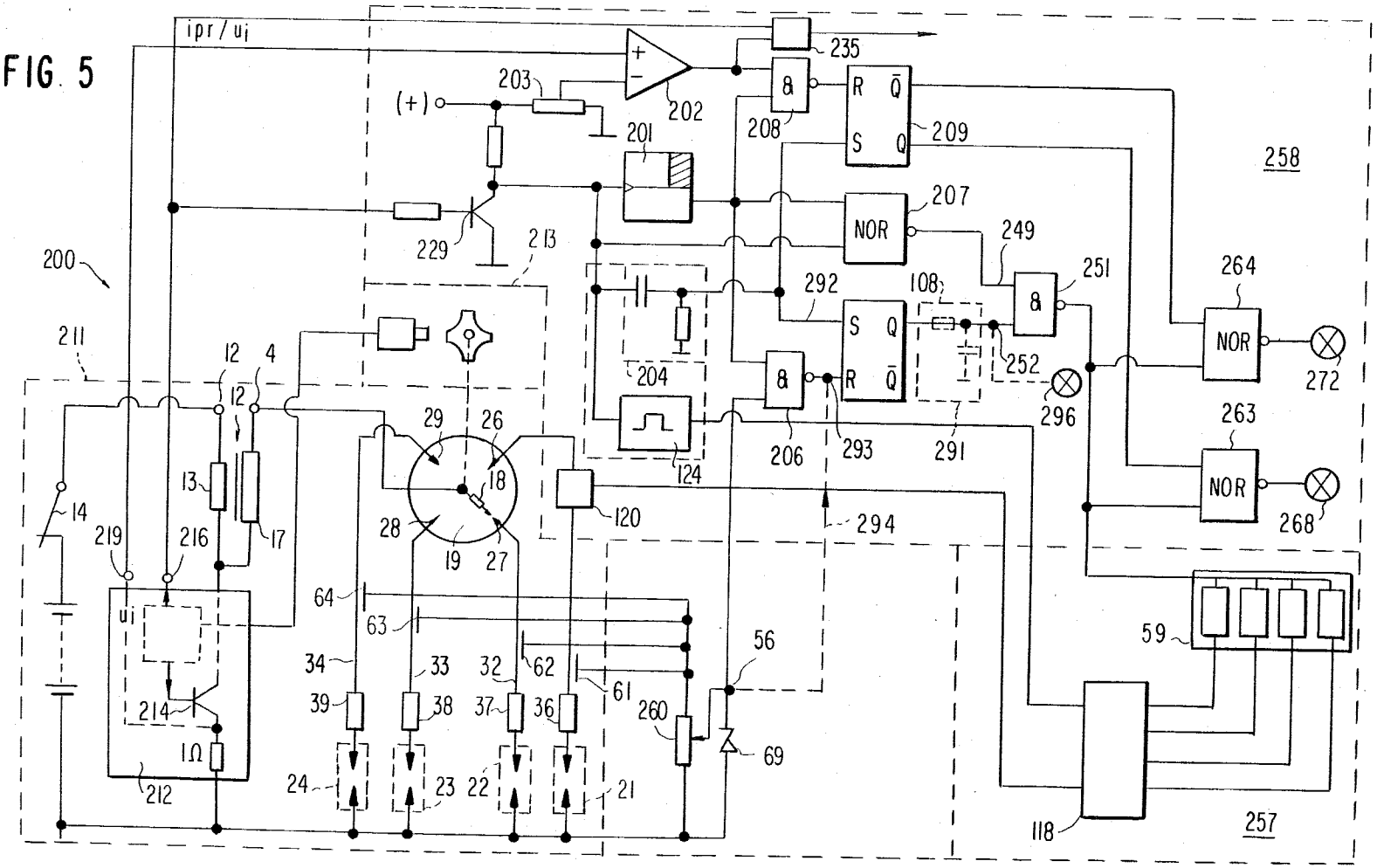
FIG. 5 is a schematic block diagram of a further preferred embodiment of an equipment according to the present invention for the recognition of misfirings, which also provides recognition of the cause of failure.

The preferred embodiment of an equipment in accordance with the present invention generally designated by reference numeral 200 and illustrated in FIG. 5, to whose details attention is expressly drawn, is specially designed for the recognition and diagnosis of misfirings of an internal combustion engine which is equipped with an electronic battery ignition—in the illustrated embodiment shown with a transistor coil ignition 211—whose construction and function are known per se. To the extent that components and functional units of the equipment 200 in accordance with FIG. 5 are constructionally or functionally equal to or analogous with similar components and units of the equipment 10 in accordance with FIG. 1, they are designated by the same reference numerals in both cases and, to this extent, attention is also drawn to the relevant description of the equipment 10 according to FIG. 1.

Of those electronic components of the switching device 212 of the transistor coil ignition 211, which provides the function of the contact breaker 42 (FIG. 1) of a conventional contact-controlled battery ignition equipment together with the advance angle control, the primary current limitation and the primary and secondary voltage limitation on the ignition coil 12, and which is controlled to provide the ignition pulses at the correct point in time for ignition by means of the output signals of an ignition pulse generator 213, represented, for example, as an inductive generator, only the main transistor 214 is indicated in FIG. 5, whereby the current flowing through the primary winding 13 of the ignition coil 12 can be influenced by the appropriate control of the main transistor 214 in the sense of the above-mentioned regulation and control functions.

In order to explain the construction and function of the equipment 200, reference will also be made hereinafter to FIG. 6.

Figure 6:
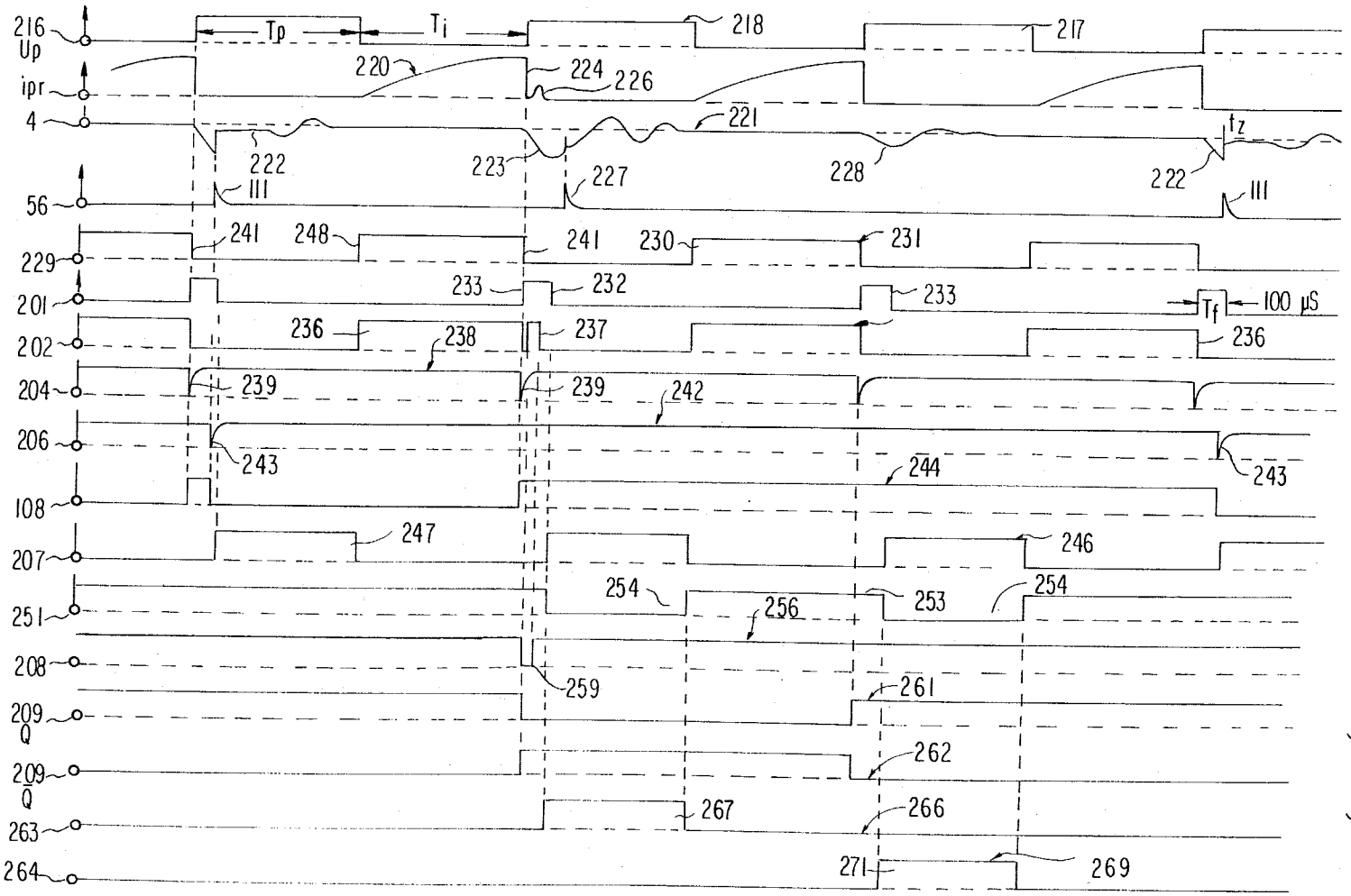
FIG. 6 is a pulse diagram to explain the function of the equipment in accordance with FIG. 5.

The switching device 212 generates, at a first output 216, a series of voltage pulses 217, whose time curve is shown by the first pulse series 218 of FIG. 6. The pulse durations $T_P$ of the voltage pulses 217 generated as high-level pulses and the pulse intervals $T_i$ between successive voltage pulses 217 correspond to the closing and opening times of the electronic switch formed by the transistor 214.

At a second output 219, the switching device 212 generates a voltage signal $U_p$ whose level is proportional to the primary current $i_{pr}$ flowing through the primary winding 13 of the ignition coil 12 and whose variation with time is shown by the second pulse series 219 of FIG. 6.

Correctly operating ignition processes are represented in the third pulse series 221 by the ignition voltage curves 222, during which at the ignition point in time $t_z$, the ignition voltage $U_Z$ (see FIG. 3) is attained and the ignition spark commences with the spark front 51 characterized by the rapid collapse of the negative plug voltage. A further plug voltage curve 223 corresponds to the case where, despite a high ignition voltage being available, no ignition spark occurs—because the distance between the electrodes is too great—and the secondary voltage of the ignition coil 12 therefore decays in an oscillating manner with high amplitudes when no voltage is applied. In this case, the voltage limitation regulation provided as part of the switching device 212 to protect the ignition coil 12 responds and the main transistor 214 is controlled again for a short period into its conducting condition so that energy is withdrawn by a recommencing primary current in the ignition coil. Such a primary current resulting from the response of the voltage limitation regulation is indicated in the second pulse series 200 of FIG. 6 by a satellite pulse 226 whose maximum coincides approximately with the voltage maximum of the first half-wave of the secondary voltage of the ignition coil 12 which occurs when no voltage is applied. Furthermore, in the case of no voltage being applied and with a high ignition voltage available, arcing again across the distributor spark gap can occur, to which the high-pass filter circuit 56 reacts with the generation of a differentiation output pulse 227 which differs from the differentiation pulse 111 (see FIG. 2) characteristic of a correct ignition spark 222 only by the time delay relative to the drop 224 in the primary current. Also shown in the third pulse series 221 by the voltage curve 228 is the case, where the ignition voltage available is decreased to such an extent, for example due to by-passing caused by dirt, that the ignition spark cannot occur and therefore the plug voltage decays oscillating as a strongly damped oscillation to a relatively low voltage level.

So that, on the one hand, the misfirings associated with no applied voltage which occur despite a high ignition voltage availability, can be recognized with certainty and also in order to obtain, on the other hand, a reliable diagnosis of the previously mentioned and varied causes for such misfirings, the following circuitry is provided for a signal processing and connecting circuit generally designated by reference numeral 258, and for the switching unit generally designated by reference numeral 257 and corresponding substantially in its structure to the analysis and indication circuit 57 in FIG. 1.

The voltage pulse signal 218 generated at the first output 216 of the switching device 212 is inverted by means of a npn-transistor 229 operated in emitter connection and is brought to the signal level necessary for the subsequent processing. The variation with time of the output signal of the transistor 229 is given by the fifth pulse series 231 of FIG. 6.

A monostable trigger circuit 201 is operated by the falling flanks of the transistor output signal 231, the output pulses 233 of this trigger circuit 201, shown in the sixth pulse series 232 of FIG. 6, have a pulse durection $T_f$ of approximately 100 μs.

The voltage output signal 220, which is generated at the second output 219 of the switching device 212 and is proportional to the primary current of the ignition coil 12, is supplied to the plus input of an operational amplifier 202 connected as a comparator, the comparative threshold of this operational amplifier 202 being adjustable by means of a potentiometer 203.

The output signal of the operational amplifier 202, shown by the seventh pulse series 234 of FIG. 6, is a series of rectangular pulses 236 and possibly 237, whose pulse durations $T_i$ and $t_i$ correspond to those time periods, in which the main transistor 214 of the switching device 212 is controlled into its conducting condition for the purpose of storing ignition energy in the ignition coil 12 or for the purpose of voltage limitation at the ignition coil 12.

The output signal 231 of the transistor 229 connected as an inverter is further supplied to an RC-differentiating element 204 whose output signal, shown in the eighth pulse series 238, is a high-level voltage signal with needle-shaped zero pulses 239, which occur together with the trailing or falling flanks 241 of the transistor output signal 231 or with the trailing or falling flanks 224 of the second switching device output signal 220.

The output pulses 233 of the monostable trigger circuit 201 are supplied to the input of a first two-input NOT AND element 206 provided as part of the processing and connecting circuit 258, the NOT AND element 206 receiving at its other input the output pulses 111 or 227 of the high-pass filter circuit 56, whose shunt resistance 260 is in this case constructed as a setting potentiometer, so that the time constants of the individual high-pass filters 260, 61, 62, 63, 64 can be set to meet the requirements.

The output signal of this first two-input NOT AND element 206, shown by the ninth pulse series 242 of FIG. 6, is a high-level voltage output signal with needle-shaped zero pulses 243, which coincide in time with the differentiation pulse 111 of the high-pass filter circuit 56, which produces these differentiation pulses 111 when the ignition spark occurs. The zero pulses associated with the differentiation pulses 227 of the high-pass filter circuit 56 are not transmitted by the two-input NOT AND element 206 because these zero pulses are not produced within the pulse duration $T_f$ of the output pulses 233 of the monostable trigger circuit 201, whose output pulses 233 also mark out a time window, within which the NOT AND element 206 can further transmit only differentiation pulses 111 of the high-pass filter circuit 56.

The trigger circuit 108 embodied as an RS flip-flop is set by the output pulses 239 of the differentiation element 204 and reset with the output pulses 243 of the two-input NOT AND element 206. The Q output signal of the flip-flop 108 resulting therefrom is indicated by the tenth pulse series 244 of FIG. 6.

The time window output pulses 233 of the monostable trigger circuit 201 are supplied to one input of a two-input NOT OR element 207 which receives the series 231 of output pulses 230 of the inverting transistor 229 at its other input.

The output signal of the NOT OR element 207 indicated by the eleventh pulse series 246 of FIG. 6 consists of rectangular pulses 247 which occur, delayed by the duration $T_f$ of the output pulses 233 of the monostable trigger circuit 201, relative to the falling flanks 241 of the output pulses 230 of the transistor 229 and drop off with their rising flanks 248 of these pulses 230.

The output pulses 247 of the NOT OR element 207 are supplied to one input 249 of a two-input NOT AND element 251 which receives the Q output signal 244 of the first RC-flip-flop 108 at its other input 252.

The output signal of the NOT AND element 251, indicated by the twelfth pulse series 253 of FIG. 6, is a high-level voltage signal as long as no misfiring occurs, into which, if misfiring occurs, low-level pulses 254 are introduced whose duration corresponds to that of the high-level output pulses of the NOT OR element 207. These low-level pulses 254 associated with the occurrence of misfiring can then be indicated to the driver by means of the indicator 59 in the way described by reference to FIG. 1, if the equipment 200 is installed as permanent equipment or to a service specialist, if the equipment 200 is provided as part of a stationary diagnosis station.

A stroke signal suitable for the control of the ring counter 118 is derived for this purpose from the output pulses 230 of the transistor 229 by means of the stroke generator 124.

The processing and connecting circuit 258 also includes a second two-input NOT AND element 208, which receives the output signal 234 of the operational amplifier 202 at one of its inputs and the time window output pulses 233 of the monostable trigger circuit 201 at its other input. The voltage output signal of this second two-input NOT AND element 208, indicated by the thirteenth pulse series 256 of FIG. 6, is a high-level signal in the normal case and is a low-level pulse 259 for the duration of an output pulse 237 of the operational amplifier 202, i.e. as long as the voltage limitation regulation of the switching device 212 is effective when no voltage is applied to the ignition coil 12; the low-level pulse 259 therefore only occurs in the case where the ignition spark does not occur because of too great a distance between the electrodes of the ignition plugs.

A second RS-flip-flop 209, provided as part of the processing and connecting circuit 258, can be reset by the low-level output pulse 259 of the two-input NOT AND element 208 and this second RS-flip-flop 209, like the first RS-flip-flop 108, is set by the null output pulses of the differentiation element 204. The variation with time, resulting from this, of the Q output signal of this second RS-flip-flop 209 is given by the fourteenth pulse series 261 and the associated, complementary variation of the $\overline{Q}$ signal of this second RS-flip-flop 209 by the fifteenth pulse series 262 of FIG. 6. The Q output signal 261 of the second RS-flip-flop 209 is, in the normal case, a high-level voltage signal which drops with the occurrence of the low-level pulse 259 of the NOT AND element 208 and returns to the high signal level with the subsequent setting pulse 239 of the differentiation element 204.

In addition, a second and a third two-input NOT OR element 263 and 264 are provided as part of the processing and connecting circuit 258, each of these elements 263 and 264 receiving the output signal 253 of the NOT AND element 251 at one of ther inputs. The Q output signal 261 of the second RS-flip-flop 209 is supplied to the second NOT OR element 263 at its other input.

The output signal of the second NOT OR element 263 resulting from this connection, which is shown by the 16th pulse series 266 of FIG. 6, is a low-level voltage signal in the normal case and a high-level pulse 267, whose duration coincides with that of the output pulses 247 of the first NOT OR element 207, only if misfiring resulting from too great a distance between the electrodes of the plug currently being monitored occurs, with which the ignition coil 12 with no voltage applied is associated. This cause of failure can thus be diagnosed from the occurrence of a high-level pulse 267 and signalled using an indicator lamp 268.

The $\overline{Q}$ output signal 262 of the second RS-flip-flop 209 is supplied to the third NOT OR element 264 at its second input. Its logic output signal given by the 17th pulse series 269 of FIG. 6, is normally a low-level signal and a high-level pulse only in the case that misfiring occurs with too low an ignition voltage availability resulting from by-passing in the ignition system, the duration of such a high-level pulse 271 being again determined by the duration of the high-level output pulses 247 of the first NOT OR element 207. Thus the second statistically important cause of misfirings can be diagnosed by means of a high-level pulse 271 and signalled using an indicator lamp 272.

Figure 7:
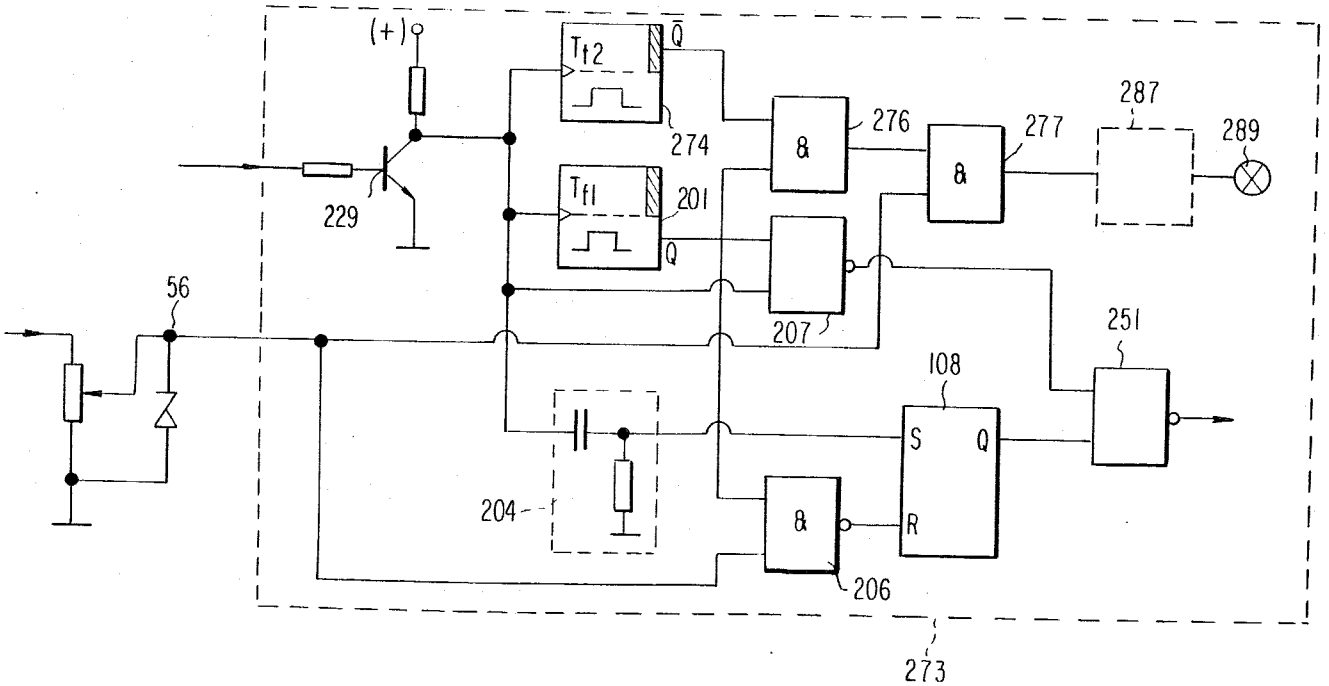
FIG. 7 is a block diagram illustrating certain details of a processing and analysis circuit usable as part of the misfire recognition equipment according to FIG. 5.

FIG. 7 shows, as part of the equipment 200 in accordance with FIG. 5, instead of the processing and connecting circuit 258, an alternate processing and connecting circuit 273, which differs from the first-mentioned mainly by the fact that that a further monostble trigger circuit 274, as a time window pulse generator, and two 2-input AND elements 276 and 277 are provided, the specific function of which will be described in greater detail by reference to FIG. 8 and 9. Elements of the circuit 273 which are structurally and functionally similar to elements of the processing and connecting circuit 258 according to FIG. 5 or 1 are in each case designated by the same reference numerals. Attention is drawn to the relevant descriptive parts associated with FIGS. 5 and 6 for the description of the connection and function of elements identical in each case.

Figure 9:
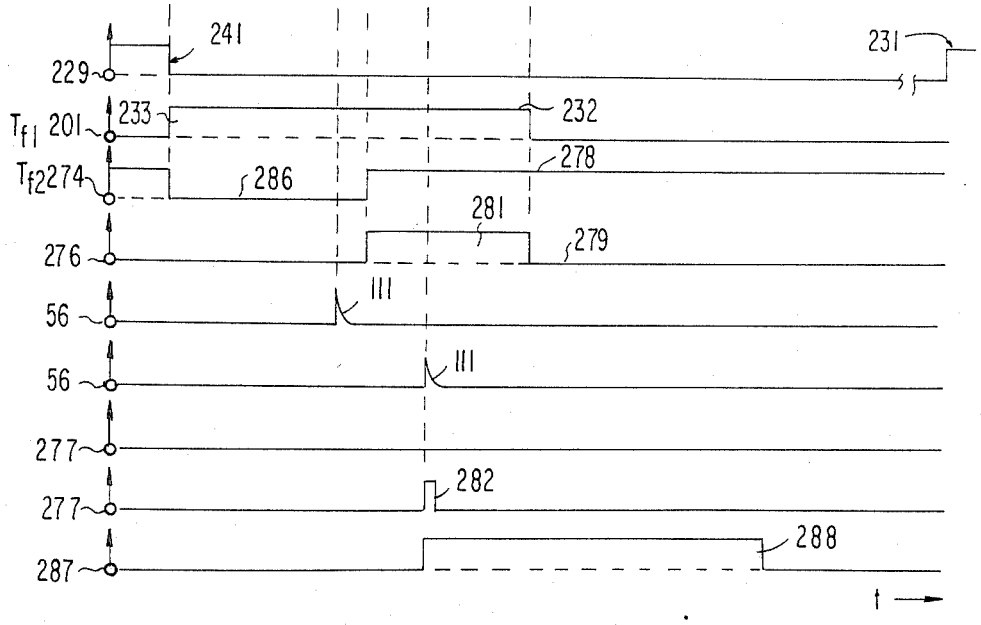
FIG. 9 is a pulse diagram explanatory of the processing and connecting circuits of FIG. 7.

The monostable trigger circuit 274, like the monostable trigger circuit 201, is triggered by the falling flanks 241 of the output signal 231 of the inverting transistor 229 (FIGS. 6 and 9).

In contrast to the monostable trigger circuit 201, whose Q output signal 232 has the variation with time shown in FIG. 6 and, on an enlarged scale, in FIG. 9, in the case of the further monostable trigger circuit 274, its Q output signal is used for further processing, this signal having the variation with time shown by the third pulse series 278 of FIG. 9, i.e. it drops from the high to the low signal level together with the falling flank 241 of the transistor output signal and after the window pulse duration $T_{f2}$, which is smaller than the window pulse duration $T_{f1}$ of the monostable trigger circuit 201, returns to the high signal level.

Both output signals 232 and 278 of the two monostable trigger circuits 201 and 274 are supplied as input signals to the first two-input AND element 276. The variation with time of the output signal of the first AND element 276 is shown by the fourth pulse series 279 of FIG. 9. It is a series of high-level voltage pulses 281, which start together with the rising flanks of the $\overline{Q}$ output signal 278 of the additional monostable trigger circuit 274 and drop off again together with the falling flanks of the output pulses 233 of the first monostable trigger circuit 201. The output signal 279 of the first AND element 276 is supplied to the input of the second AND element 277, which receives the differentiated output pulses 111 of the high-pass filter circuit 56 at its other input. The second AND element 277 thus provides a—short-duration—high-level output pulse 282 only when it receives an output pulse 111 of the high-pass filter circuit 56 within the pulse duration of the output pulse 281 of the first AND element 276.

Figure 8:
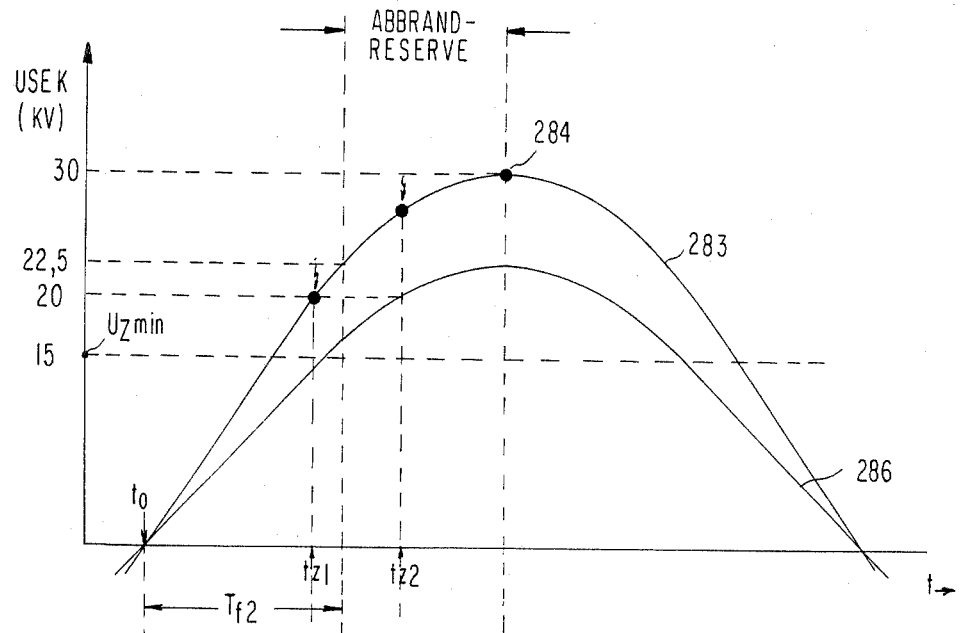
FIG. 8 is a diagram illustrating the ignition voltage availability curves to explain the function of the processing and connecting circuit in accordance with FIG. 7.

An ignition voltage availability curve is indicated by curve 283 in FIG. 8 for the unloaded case which, for example, occurs if the voltage variation is measured between the plug connection and the vehicle ground, with the former disconnected, after the main transistor 214 of the switching device 212 (FIG. 5) is switched to its shut-off condition at time $t_0$. The voltage maximum 284 in the availability curve 283 is then approximately 30 kV. The minimum ignition voltage $U_{Zmin}$ is approximately 15 kV. For purposes of explanation, it is assumed that the time period calculated from the time $t_0$ and which passes before the maximum value 284 of the ignition voltage availability could be attained is 100 μs. The first monostable trigger circuit 201 for both the illustrative embodiment according to FIG. 5 and the illustrative embodiment according to FIG. 7 is then preferably so designed that the duration $T_f$ or $T_{f1}$ of its high-level output pulses 233 corresponds precisely to this period of time and the second monostable trigger circuit 274 is so designed that after the duration $T_{f2}$ of its $\overline{Q}$ OV output pulse, the available ignition voltage corresponds to approximately 75% of the maximum value 284, i.e. 22.5 kV for the selected illustrated case. If the ignition voltage requirement is lower than this value, for example only 20 kV, so that the ignition spark has already commenced at the ignition time point $t_{z1}$, then no output signal of the AND element 277 can be released by the differentiated pulse 111 associated with it and shown by the fifth pulse series of FIG. 9.

If the ignition voltage requirement is even higher because the distance between the electrodes has become greater due to burning or because, as is shown for example by the additional ignition voltage availability curve 286, the ignition voltage available has become smaller because of by-passing in the ignition system, with the result that an ignition spark only commences at the ignition point in time $t_{z2}$, then an output pulse 282 of the AND element 277 is generated. The appearance of this output pulse 282 is in every case an indication of the fact that the ignition equipment is operated in a limiting region of its functional capability.

In the case of a misfire recognition equipment 200 which is constructed as installed equipment in a vehicle and whose processing and recognition circuit is constructed either in the manner shown in FIG. 7 or is realized using the modifications indicated in FIGS. 7–9, it is appropriate that the occurrence of output pulses 282 of the AND element 277 should be indicated to the driver. An indication meeting this requirement can be realized by controlling a further monostable trigger circuit 287, shown dashed in FIG. 7, using the short-duration output pulse 282 of the AND element 277 so that the additional trigger circuit 287 produces a high-level voltage output signal which is supplied to a warning lamp 289; the first lighting-up of this warning lamp then indicates to the driver that the ignition equipment is indeed still functional but that checking and maintenance of it will be desirable in the immediate future. So that the appropriate information can be obtained, provision can also be made within the switching device 212 for a setting element by means of which, for example by acting on the voltage limitation regulation, the ignition voltage available can be lowered in a defined manner—stepwise or continouously—or set to a defined value. By an appropriate reduction of the ignition voltage available to the point where there is a first appearance of misfiring, which can be recognized using the recognition equipment 10 or 200 described with reference to FIG. 1 and FIG. 5 and, if required, diagnosed with respect to their causes, it is then also possible to determine whether there is still a sufficient ignition voltage reserve or whether the ignition system requires maintenance.

In order to explain a particularly simple embodiment of misfire recognition equipment according to the present invention, attention is once more drawn to FIG. 5. In this case, it is assumed that only the RS-flip-flop 108 and an integrating element 291, connected to the Q output of the RS-flip-flop receiving the output signal 238 of the differentiating element 204 at its setting input 292 and the differentiating output pulses 111 of the high-pass filter circuit 56 directly at its reset input 293, as shown by the signal conductor 294 (shown in dashed lines). An indicator 296 constructed, for example, as a light-emitting diode is operated directly by the output signal of the integrating element 291. An equipment 200 modified in this manner operates as follows:

As long as no misfirings occur, each setting pulse 239 of the differentiating element 204 is followed directly, i.e. as soon as the ignition spark occurs, by a reset pulse 111 of the high-pass filter circuit 56, wth the result that the output voltage of the integrating element 291 (assume an appropriate design for it) remains so low that the indicator 296 does not illuminate. If—because of misfiring—a reset pulse of the high-pass filter circuit does not appear, so that the Q output signal of the RS-flip-flop 108 remains in existence as a high-level signal until the occurrence of the next reset pulse 111 of the high-pass filter circuit 56 characteristic of correct ignition functioning, then the output signal level of the integrating element 291 exceeds the response threshold of the indicator 296 and an indication will be given that a misfiring has occurred. In this very simple embodiment, but also in the embodiment explained with reference to FIG. 7, the misfire recognition equipment in accordance with the present invention is particularly suitable as installed equipment for a motor vehicle.

Figure 10:
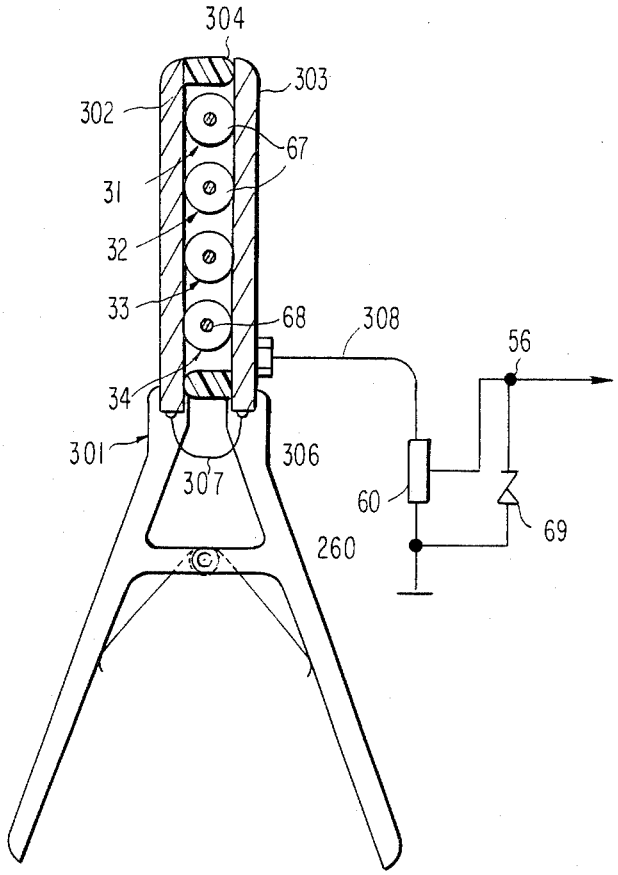
FIG. 10 is an elevational view, partly in cross section of a coupling grip for a capacitative coupling of misfire recognition equipment according to the present invention to the plug leads of a motor vehicle.

Finally, the construction of an appropriate coupling grip 301 for the capacitative coupling of plug leads 31 to 34 with the misfire recognition equipment 10 or 200 in accordance with the present invention provided as part of a stationary diagnosis device will be dealt with by reference to FIG. 10; the coupling grip 301 is thereby constructed as a spring-loaded, self-closing grip. The grip jaws 302 and 303 are constructed as conducting, square plates with a surface of approximately 5×5 cm and electrically insulated relative to the grip handles. The grip can be applied with a parallel position of its grip jaws 302 and 303 to the insulation coatings 68 of the plug leads 31 to 34, in the arrangement shown in FIG. 10, the insulation coatings 68 being somewhat crushed. The grip jaws 302 and 303 forming the electrodes of the coupling capacities 61 to 64 of the high-pass filter circuit 56 are supported against one another in the functional position shown by insulating plastic bars 304 and 306. The grip jaws 302 and 303 are connected with one another by way of a flexible conducting band 307. The jaws 302 and 303 or coupling capacity electrodes are connected with the resistance 60 or 260 located in the equipment by means of a connecting conductor 308; the resistance 60 or 260, in conjunction with the coupling capacities 61 to 64 (see FIGS. 1 and 5) formed by the grip jaws 302 and 303 form the high-pass filter circuit 56.

Figure 11:
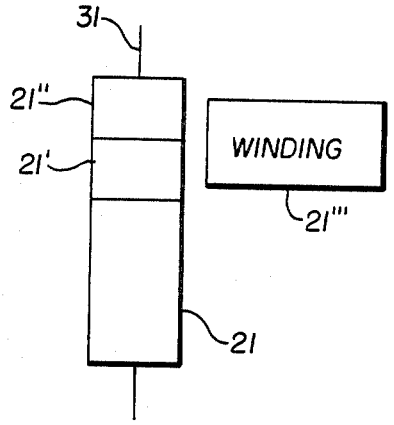
FIG. 11 shows a current sensor.

FIG. 11 shows a current sensor comprising an indication winding 21''' operatively connected with one of a plug connector 21'', and insulation body 21' of a spark plug 21.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. An equipment for recognizing misfirings in an externally controlled ignition internal combustion engine comprising plural ignition circuit means each including a spark plug, an ignition distributor means for conducting an ignition voltage in predetermined order to said plural ignition circuit means, at least one differentiating circuit means constructed as a high-pass filter means coupled to each ignition circuit means between the ignition distributor means and the respective spark plug for decoupling a voltage signal from the ignition circuit means, a voltage circuit being exclusively associated with the voltage changes occurring at the initiation of the ignition spark over the spark gap of the plug, a reference voltage circuit means for generating electrical output signals characteristic of the firing point in the ignition circuit means, OR gate means receiving the output of the high-pass filter means, and analysis and indicator circuit means receiving the output of the OR gate means for producing output signals characteristic of correct or erroneous functioning of the ignition system by logic processing of the filter means output signals and of the output signals of the reference circuit means.

2. An equipment according to claim 1, characterized in that the lower limit frequency of the high-pass filters is at least 100 times greater than the natural frequency of oscillation of each of the ignition circuit means, at which the plug voltage decays in this ignition circuit means after failure of the ignition spark.

3. An equipment according to claim 2, characterized in that the high-pass filters are constructed as RC-differentiating elements, which include one coupling condenser each and a common shunt resistance.

4. An equipment according to claim 3, characterized in that the coupling capacities of the RC-elements are small compared with the conductor capacities of plug leads, and in that the shunt resistance has a value of approximately 100 ohm.

5. An equipment according to claim 3, characterized in that the capacitative elements of the RC-elements used as high-pass filters include surface electrodes attachable to plug leads, which surround the plug leads at least over a sector.

6. An equipment according to claim 5, characterized in that the surface electrodes are constructed as an elastically expandable clip-like element surrounding the plug leads over a periphery of at least 180° and abutting smoothly on insulation coating in the plug leads, said clip-like elements being interconnected by intermediate pieces and being made from flat rod-shaped insulated conducting material.

7. An equipment according to claim 6, characterized in that the shunt resistance of the RC-elements, through which the coupling capacities are connected to circuit ground, is arranged in direct vicinity of the coupling capacities.

8. An equipment according to claim 3, characterized in that the shunt resistance of the RC-elements, through which the coupling capacitance are connected to circuit ground, is arranged in direct vicinity of the coupling capacities.

9. An equipment according to claim 3, characterized in that suppressor resistances are connected in series with the spark plug gaps and the condensers of the RC-high-pass filters are coupled to the individual ignition circuit means between the spark plug gaps and suppressor resistances.

10. An equipment according to claim 9, characterized in that, as part of the coupling capacities of the high-pass filters, external cylindrical electrodes attached to the insulation bodies of the spark plugs are provided, each of said external cylindrical electrodes being connected to the circuit ground by way of a shunt resistance.

11. An equipment according to claim 9, characterized in that the lower limit frequency of the high-pass filters coupled to the ignition circuit means between the suppressor resistances and the spark gaps of the spark plugs is at least 50 to 100 MHz.

12. An equipment, according to claim 4, characterized in that a current sensor means is provided which is operable to generate an output signal characteristic of the current associated with a spark front of the ignition spark.

13. An equipment according to claim 12, characterized in that an induction winding operatively connected with one of plug connector and insulation body of the spark plug of the respective ignition circuit means is provided as the current sensor means.

14. An equipment according to claim 1, characterized in that a current sensor means is provided which is operable to generate an output signal characteristic of the current associated with a spark front of the ignition spark.

15. An equipment according to claim 14, characterized in that an induction winding operatively connected with one of plug connector and insulation body of the spark plug of the respective ignition circuit means is provided as the current sensor means.

16. An equipment according to claim 1, characterized in that the reference circuit means includes a reference signal generator which is operable to generate reference pulses occurring at the time of ignition, an analysis pulse generator which is operable to generate short-duration analysis pulses coinciding with the rear flanks of the reference pulses, and a setting pulse generator which, in its turn, is operable to generate setting pulses of short duration coinciding with the rear flanks of the analysis pulses and in that the analysis circuit means includes a trigger circuit which can be set by the setting pulses of the reference circuit means to a defined signal level and can be reset by the output pulses of the high-pass filter circuits, the output signal of said trigger circuit being applied to the input of a two-input AND element which receives the analysis pulses of the reference circuit means at its other input.

17. An equipment according to claim 16, characterized in that the analysis circuit means includes a ring counter means which can be reset each time by a synchronizing pulse derived from the ignition voltage at a predetermined cylinder of the internal combustion engine, said ring counter means receiving, as counting pulses, clock pulses occurring at the time of ignition of the individual ignition circuit means and being operable to indicate the currently activated ignition circuit means by its counter-reading output signals, and in that an LED indicator means is associated with each ignition circuit means, which is operable to be activated by the output signals of the AND element and the ring counter means, the individual indicator means associated with the AND element output signals being connected in parallel and the counter-reading output signals being conducted individually to the corresponding indicator means.

18. An equipment with processing and connecting circuit means according to claim 1, further comprising a storage means, which can be set by the output signals characteristic of the intended ignition point and reset by means of differentiated output pulses of the high-pass filter circuit.

19. An equipment according to claim 18, characterized in that the storage means is constructed as an RS-flip-flop to whose Q output is operatively connected an integrating element.

20. An equipment according to claim 18, further comprising a timing means which limits a time window, within which storage means can receive reset pulses to a time period which commences with the initiation of the ignition voltage rise and corresponds approximately to the period of time which passes until the maximum of the available ignition voltage is attained with no voltage applied to the ignition coil.

21. An equipment according to claim 20, wherein a time window indicated by the timing means is determined by the output pulse duration of a monostable trigger circuit provided as a time means, said trigger circuit being triggered by the leading flank of a pulse signal starting with the rise in ignition voltage.

22. An equipment according to claim 20, characterized in that the timing means is constructed as an adaptive element whose time window pulse duration ends with the attainment of a first extreme value of the voltage across the plug electrodes.

23. An equipment according to claim 20, characterized in that a second timing means is provided which, within the time window delimited by the first timing means, delimits a second time window which commences with the first time window but is shorter than the latter, the second time window being so dimensioned that for a low ignition voltage requirement the ignition pulse comes into existence within the second time window, and to produce an output signal whenever an ignition pulse occurs still within the first time window but outside the second time window.

24. An equipment according to claim 23, characterized in that the first time window is determined by the pulse duration of a high-level output pulse of the first timing means and the second timing window is determined by the pulse duration of a low-level output pulse of the second timing means, in that the output pulses of the time means are supplied as input pulses to a two-input AND element, whose output signal is supplied to one input of a second two-input AND element, which receives the differentiated output pulses of the high-pass filter circuit means at its other input, and in that an indicator means is operable to be controlled by the output pulses of said second AND element.

25. An equipment according to claim 24, characterized in that the indicator means is operable to be controlled by the output signal of a monostable trigger circuit means triggered by the output pulses of the second AND element.

26. An equipment according to claim 20, characterized in that a diagnosis signal characteristic of too large an electrode gap is produced from a conjunctive logic linking of a signal characteristic of the occurrence of a misfiring with a signal characteristic of the activation of a voltage limitation control at the ignition coil.

27. An equipment according to claim 20, characterized in that a signal, which indicates that in the case of a misfiring, this misfiring is due to short-circuiting in the ignition system, is obtained from a conjunctive linking of signals, which indicate that a misfiring has occurred, on the one hand, but that a voltage limitation control of the ignition system has not responded within the first time window, on the other hand.

28. An equipment with a switching means of a transistor coil ignition installation according to claim 20, characterized in that the switching means is used to control the primary current of the ignition coil, said switching means being operable to provide a voltage limitation by switching a transistor of the switching means into the conductive condition in addition to providing the correct ignition point control of an ignition spark series in the case of an excessive ignition voltage supply or demand, and in that this switching means emits a series of voltage pulses at a first output, the duration of said voltage pulses corresponding to the blockage phase of the said transistor and emits, at a second output, a voltage signal whose level is proportional to the current flowing through a primary coil.

29. An equipment according to claim 28, characterized in that an RS-flip-flop provided as a storage means can be set by the output pulses of a differentiating element, to which are supplied, as input signals, pulses which are generated from an inversion of the voltage pulses emitted at the first output of the switching means, and which can be reset by zero output pulses of a two-input NOT AND element, to which are supplied, as input signals, on the one hand, output pulses of the time window means and, on the other hand, the differentiated pulses of the high-pass filter circuit means, in that a two-input NOT OR element is provided, which receives at one of its inputs the inverter output signal, and at its other input the output pulses of the time window means, and in that the output signal of the NOT OR element and the Q output signal of the RS-flip-flop are supplied as input signals to a two-input NOT AND element.

30. An equipment according to claim 29, further comprising a further RS-flip-flop, whose Q output can be set to high output signal level by the output pulses of the differentiating element and which receives at its reset input, the output signal of a two-input NOT AND element, to which is supplied as the first input signal the output signal which is a high-level voltage signal if the final transistor of the switching means is conducting and a voltage drop occurs over its ground connection resistance, and to which, as a second input signal, is supplied the output signal of the time window element, and in that a first two-input NOT OR connecting element is provided, to which are supplied as input signals, on the one hand, the output signals of the AND element connected in the output of the first-mentioned flip-flop and, on the other hand, the Q output signal of the further flip-flop, and in that a second two-input NOT OR connecting element is provided, to which are supplied as input signals the output signals of the AND element as well as the Q output signal, inverse to the Q output signal, of the further flip-flop.

31. An equipment according to claim 20, further comprising a setting means enabling the setting of a predetermined available ignition voltage which is lower than the maximum ignition voltage characteristically available for the ignition equipment.

32. An equipment according to claim 20, characterized in that it is constructed as onboard, installed equipment of a motor vehicle.

33. An equipment according to claim 20, characterized in that, in association with stationary diagnostic equipment, a coupling grip is provided having grip jaws constructed as conducting plates which can be applied mutually parallel to plug leads, the grip being constructed as a self-closing grip, spring-loaded in the closing direction, whose grip jaws are connected to one another via a flexible conductor and can be connected to the shunt resistance, located in the equipment, of the high-pass filter circuit means.

34. An equipment according to claim 1, further comprising a setting means enabling the setting of a predetermined available ignition voltage which is lower than the maximum ignition voltage characteristically available for the ignition equipment.

35. An equipment according to claim 2, characterized in that it is constructed as onboard, installed equipment of a motor vehicle.

36. An equipment according to claim 1, characterized in that, in association with stationary diagnostic equipment, a coupling grip is provided having grip jaws constructed as conducting plates which can be applied mutually parallel to plug leads, the grip being constructed as a self closing grip, spring-loaded in the closing direction, whose grip jaws are connected to one another via a flexible conductor and can be connected to the shunt resistance, located in the equipment, of the high-pass filter circuit means.

37. An equipment according to claim 2, characterized in that the high-pass filters are constructed as RC-differentiating elements, which include one coupling condenser each and a common shunt resistance, with which a diode is connected in parallel, said diode being poled in the blocking direction with reference to the differentiated pulses associated with the initiation of the ignition spark.

* * * * *